US009675900B2

(12) United States Patent
Sokolov

(10) Patent No.: US 9,675,900 B2
(45) **Date of Patent: *Jun. 13, 2017**

(54) CONSTRUCTION-SET ELEMENTS

(71) Applicant: Dmitriy Andreyevich Sokolov, Moscow (RU)

(72) Inventor: Dmitriy Andreyevich Sokolov, Moscow (RU)

( * ) Notice: Subject to any disclaimer, the term of this patent is extended or adjusted under 35 U.S.C. 154(b) by 0 days.

This patent is subject to a terminal disclaimer.

(21) Appl. No.: 14/952,937

(22) Filed: Nov. 26, 2015

(65) Prior Publication Data

US 2016/0082361 A1 Mar. 24, 2016

Related U.S. Application Data

(63) Continuation of application No. PCT/RU2013/000754, filed on Oct. 30, 2013.

(51) Int. Cl.
*A63H 33/04* (2006.01)
*A63H 33/08* (2006.01)

(52) U.S. Cl.
CPC ..... *A63H 33/084* (2013.01); *A63H 33/04* (2013.01); *A63H 33/08* (2013.01); *A63H 33/086* (2013.01)

(58) Field of Classification Search
CPC ..... A63H 33/04; A63H 33/06; A63H 33/08; A63H 33/086
See application file for complete search history.

(56) References Cited

U.S. PATENT DOCUMENTS

| | | | | |
|---|---|---|---|---|
| 3,867,784 | A | 2/1975 | Lange | |
| 4,569,665 | A * | 2/1986 | Belton | A63H 33/04 446/114 |
| 5,350,331 | A | 9/1994 | Glickman | |
| 5,575,120 | A | 11/1996 | Handley | |
| 5,848,927 | A | 12/1998 | Frederikse | |
| 6,561,866 | B1 | 5/2003 | Lee | |
| 6,648,715 | B2 * | 11/2003 | Wiens | A63H 33/062 446/121 |

(Continued)

FOREIGN PATENT DOCUMENTS

| | | | |
|---|---|---|---|
| CN | 2907810 | Y | 6/2007 |
| JP | 2010279671 | A | 12/2010 |

(Continued)

*Primary Examiner* — Gene Kim
*Assistant Examiner* — Alyssa Hylinski
(74) *Attorney, Agent, or Firm* — Mark David Torche; Patwrite LLC

(57) ABSTRACT

Construction-set elements for use in kits for children and in puzzles. The construction-set element contains a flat rectangular base and a connecting assembly. The connecting assembly is formed of four groups of protrusions, provided on the base. The protrusions of the first group have a cruciform cross-section. The protrusions of the second group are tubular with a square-shaped cross-section. The protrusions of the third group are in the form of rectangular plates having barrier-walls along the short sides thereof, the barrier-walls being angled toward one another with the formation of a gap. In the fourth group, the protrusions are positioned at the corners of the base and are made in the form of L-shaped elements, the sides of which are perpendicular to the plane of the base.

2 Claims, 28 Drawing Sheets

(56) References Cited

U.S. PATENT DOCUMENTS

| | | | | |
|---|---|---|---|---|
| 9,409,099 | B2 * | 8/2016 | Sokolov | A63H 33/08 |
| 9,579,588 | B2 * | 2/2017 | Sokolov | A63H 33/08 |
| 2009/0117815 | A1 | 5/2009 | Hiraide | |
| 2011/0045733 | A1 | 2/2011 | Saigo | |
| 2013/0115849 | A1 * | 5/2013 | Yap | A63H 9/00 446/128 |

FOREIGN PATENT DOCUMENTS

| | | | |
|---|---|---|---|
| KR | 101221648 | B | 1/2013 |
| RU | 2468848 | C1 | 1/1999 |
| RU | 2199364 | C2 | 2/2003 |
| RU | 2441686 | C2 | 2/2012 |
| SU | 1507411 | A1 | 9/1989 |

* cited by examiner

CONSTRUCTION-SET ELEMENTS

TECHNICAL FIELD

This invention relates to construction components, and particularly to construction elements (components) that can be used both in toy construction sets and puzzles.

BACKGROUND OF THE INVENTION

One known analog from prior art is the construction element from the company "LEGO", containing a base, which is created, as a rule, in the form of a parallelepiped with one or more interlocking joints (U.S. Pat. No. 5,848,927 to Frederiksen, 15 Dec. 1998).

A disadvantage of the known construction element is poor functionality because its design permits only one possible type of connection between identical construction elements.

SUMMARY OF THE INVENTION

The object of the claimed invention is to create a construction element which provides many options for interlocking similar elements.

The technical result includes increasing the functional possibilities of the construction element by increasing the connection options of the proposed construction element with other construction elements.

The technical result of the first construction element embodiment is achieved due to the construction element containing a base and interlocking joint. The base is made flat and has a rectangular form, with sides made in multiples of <<a>>. The interlocking joint is created by positioning protrusions on the base, which form four groups of protrusions. The first group of protrusions is positioned at least on one side of the base made with a cross-shaped cross-section with a distance between opposite ends of a cross equal to <<a>>. The height of the protrusions in the first group is greater than <<0.5a>> but no greater than <<a>>.

The second group has protrusions positioned on at least one side of the base, they are made tubular, with cross-sections in the form of a square having side length in the channel of tubular protrusion equal to <<a>>. The height of the protrusions in the second group is equal to <<0.5a>>. In the third group, protrusions are made in the form of rectangular plates, positioned with its midline on the ends of the base, flush with these ends, and having ledges with width equal to <<a>> along the short sides protruding not more than <<0.5a>> from the base ends. The ledges are angled towards each other with a gap formed between their end parts no greater than <<a>>.

Protrusions in the fourth group are made in the form of corners, having shelves positioned perpendicular to the base planes on its adjacent ends and flush with these ends. Shelves have a length equal to <<a>> and a width no greater than <<0.5a>>. All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid is <<0.5a>>. Protrusions of the first group are positioned at points where the grid lines intersect. Protrusions of the second group are positioned at points where the diagonals of the cells of the coordinate grid intersect. Protrusions of the third group are positioned in the middle between the neighboring protrusions of the first group that are positioned flush with the ends of the base. Protrusions of the fourth group are positioned in the corners of the base.

The technical result of the second construction element embodiment is achieved due to the construction element containing a base and interlocking joint. The base is made flat and has a rectangular form, with at least one side equal to <<a>> and the other a multiple of <<a>>. The interlocking joint is created by positioning protrusions on the base which form three groups of protrusions. The first group of protrusions is positioned at least on one side of the base and having cross-shaped cross-sections with distance between opposite ends of the cross equal to <<a>>. The height of the protrusions in the first group is greater than <<0.5a>> but no greater than <<a>>. The second group has protrusions made in the form of rectangular plates, positioned with its midline on the ends of the base, flush with these ends, and having ledges with width equal to a along the short sides protruding not more than <<0.5a>> from the base ends. The ledges are angled towards each other with a gap formed between their end parts no greater than <<a>>. Protrusions in the third group are made in the form of corners, having shelves positioned perpendicular to the base planes on its adjacent ends and flush with these ends. Shelves have a length equal to <<a>> and a width no greater than <<0.5a>>.

All protrusions are positioned on the base in accordance with the coordinate grid of mutually perpendicular lines parallel to base edges. The distance between neighboring lines of the coordinate grid is equal to <<2a>>. The distance between the base edges and neighboring lines on the coordinate grid is <<0.5a>>.

Protrusions of the first group are positioned at points where the grid lines intersect. Protrusions of the second group are positioned in the middle between the neighboring protrusions of the first group that are positioned flush with the ends of the base. Protrusions of the third group are positioned in the corners of the base.

BRIEF DESCRIPTION OF THE DRAWINGS

FIGS. 24-28 are presented only for visibility as far as the different elements of the construction set are better seen here due to retouch there.

DETAILED DESCRIPTION OF THE INVENTION

Figure 1:
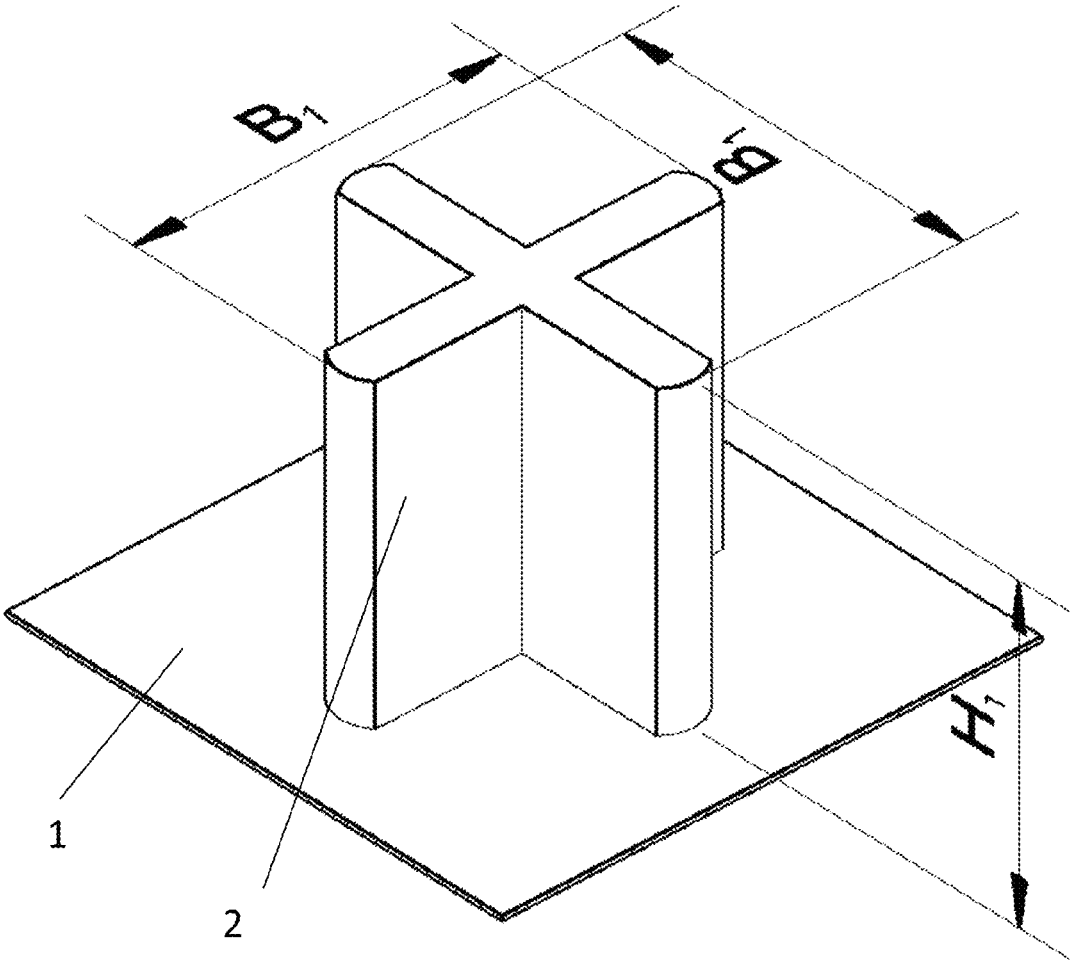
FIG. 1 shows protrusion of the first group.
Figure 2:
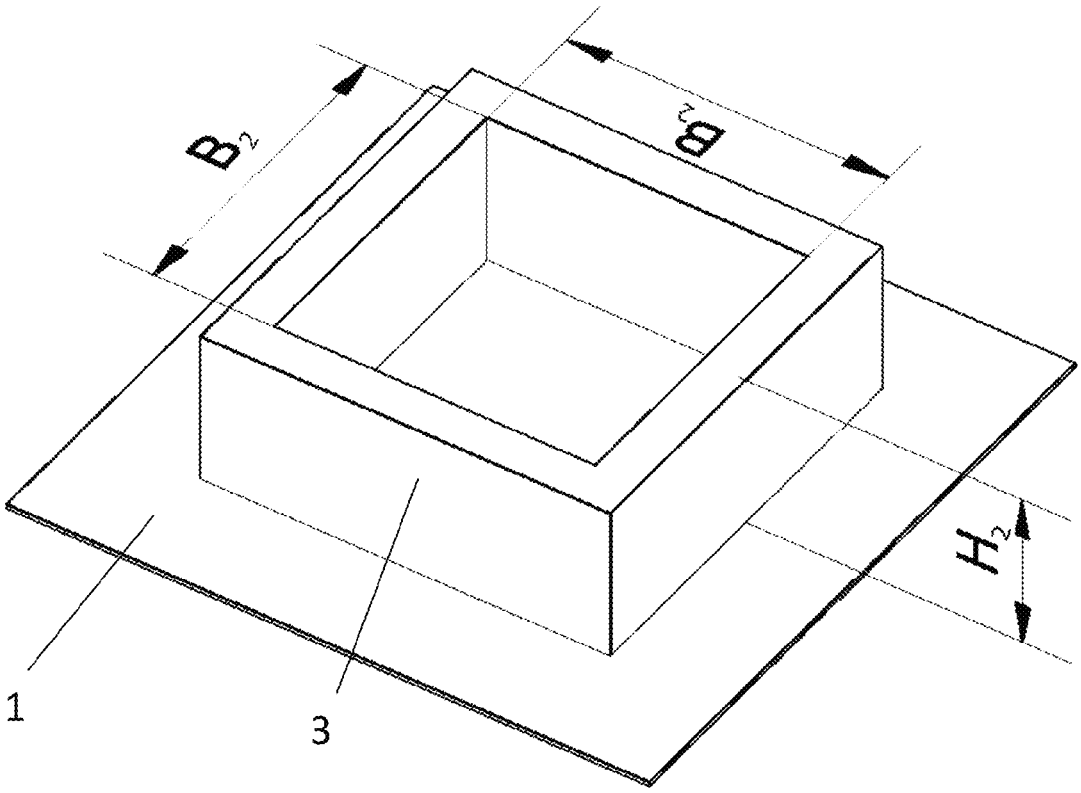
FIG. 2 shows protrusion of the second group for construction elements according to the first embodiment.
Figure 3:
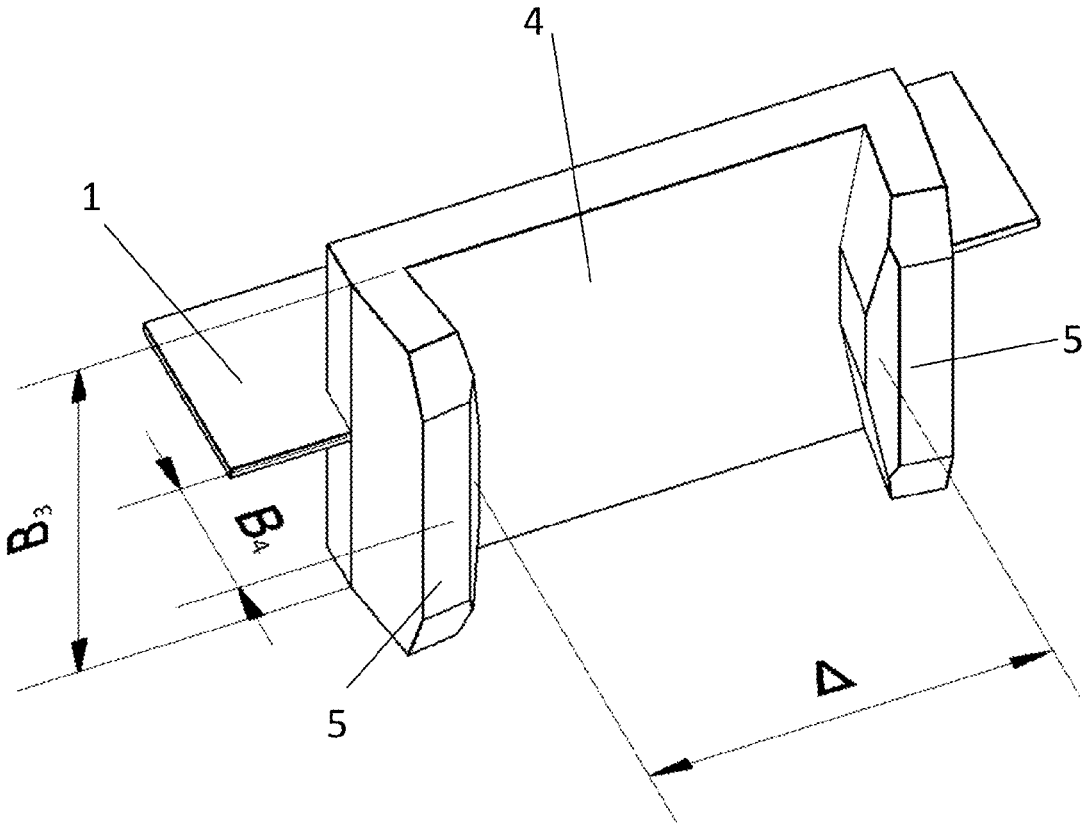
FIG. 3 shows protrusion of the third group for construction elements according to the first embodiment or protrusion of the second group for construction elements according to the second embodiment.
Figure 4:
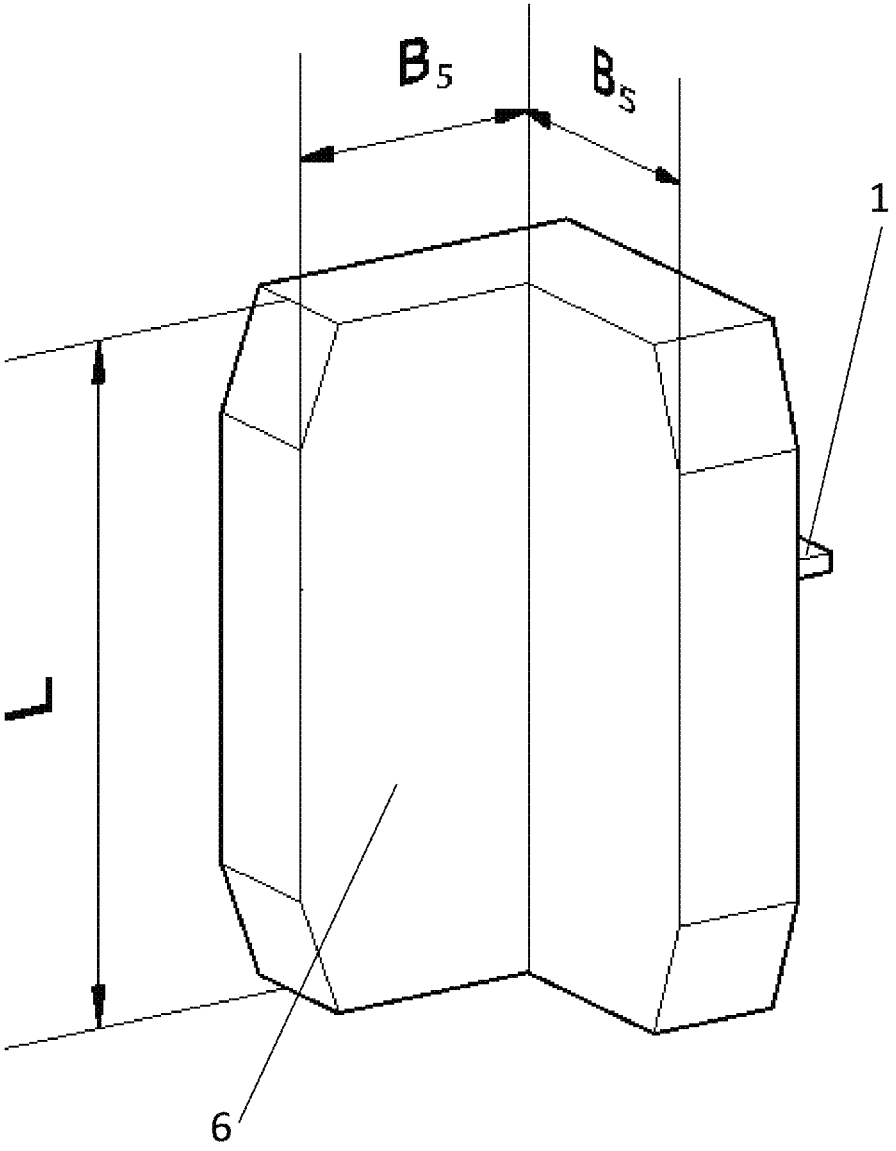
FIG. 4 shows protrusion of the fourth group for construction elements according to the first embodiment or protrusion of the third group for construction elements according to the second embodiment.

Here we describe a construction element, according to the first embodiment, see FIGS. 1-6, where the interlocking joint made of protrusions and construction element according to the first embodiment with abovementioned interlocking joint are represented respectively.

Construction element, according to the first embodiment, contains a base 1, made flat and having a rectangular form, with sides made in multiples of <<a>>, and an interlocking joint, created by positioning protrusions on the base, which form four groups of protrusions. The first group of protrusions 2 (see FIGS. 1, 5, 6, 7, 8, 10 and 16) is positioned at least on one side of the base 1. The height of the protrusions 2 (see FIG. 1) <<H1>> in the first group is greater than <<0.5a>> but no greater than <<a>>. The protrusions 2 are made with a cross-shaped cross-section where a distance <<B1>> between opposite ends of the cross is equal to <<a>>. The protrusions 3 are of the second group according to the first embodiment (see FIGS. 2, 5, 6, 10, 12, 13, 14, 17 and 18) are also positioned at least on one side of the base 1. The height of the protrusions 3 <<H2>> is equal to <<0.5a>>. The protrusions 3 are made tubular, with cross-sections in the form of a square having side length in channel of the tubular protrusion 3 equal to <<a>>. In the third group, protrusions 4 according to the first embodiment (see FIGS. 3, 5, 6, 7, 8, 11, 12, 13, 15, 16, 17 and 18) are made in the form of rectangular plates, positioned with its longest midline on the ends of the base 1, and having ledges 5 along their short sides. The ledges 5 with width <<B3>> equal to <<a>> are maid protruding from the base ends by a length <<B4>> (see FIG. 3) which is not more than <<0.5a>>, angled towards each other with a gap formed between their end parts no greater than <<a>> (see FIGS. 3, 5, 6, 7, 8, 11, 12, 13, 15, 16 and 17). Ledges 5 are angled towards each other with a gap <<Δ>> formed between their end parts no greater than <<a>> (see FIG. 3). Protrusions 6 in the fourth group according to the first embodiment are made in the form of corners, having shelves positioned perpendicular to the base 1 planes on its adjacent ends and flush with these ends, The shelf length <<L>> is equal to <<a>> and width <<B5>> is no greater than <<0.5a>>. Protrusions 2, 3, 4, 6 are positioned on the base 1 in accordance with the coordinate grid 7 (see FIGS. 5 and 7) of mutually perpendicular lines parallel to base 1 edges. The distance <<B6>> between neighboring lines of the coordinate grid 7 is equal to <<2a>>, wherein the distance <<B7>> between the base 1 edges and neighboring lines on the coordinate grid 7 is equal to <<0.5a>>. In the first group according to the first embodiment protrusions 2 are positioned at points where the coordinate grid 7 lines intersect. In the second group according to the first embodiment protrusions 3 are positioned at points where the diagonals 8 (see FIG. 5) of the cells of the coordinate grid 7 intersect. Protrusions 4 of the third group according to the first embodiment are positioned in the middle between the neighboring protrusions 2 of the first group that are positioned flush with the ends of the base 1. In the fourth group according to the first embodiment protrusions 6 are positioned in the corners of the base 1.

Here we describe a construction element, according to the second embodiment. FIGS. 1, 3, 4, 7, 8 show protrusions creating interlocking joint and a construction element, according to the second embodiment, containing the abovementioned interlocking joint.

Construction element, according to the second embodiment, contains a base 1, made flat and having a rectangular form, with at least one side equal to <<a>>, the other a multiple of <<a>>, and an interlocking joint, created by positioning protrusions on the base 1, which form three groups of protrusions. The first group of protrusions 2 according to the second embodiment are similar to of protrusions 2 according to the first embodiment. They are positioned at least on one side of the base 1. The height <<H1>> of the protrusions 2 is greater than <<0.5a>> but no greater than <<a>>. The protrusions 2 are made with cross-shaped cross-sections with a distance <<B1>> between opposite cross ends equal to <<a>>. In the second group according to the second embodiment, protrusions 4 are similar to protrusions 4 of the third group according to the first embodiment and made in the form of rectangular plates, positioned with its long midline on the ends of the base 1, and having ledges 5 along short sides, flush with these ends. Ledges 5 with a width length "B3" equal to <<a>> (see FIG. 8) are protruding from the base ends by a length "B4" (see FIG. 3), which is not more than <<0.5a>>. Ledges 5 angled towards each other with a gap <<Δ>> formed between their end parts no greater than <<a>> (see FIG. 3). Protrusions 6 in the third group according to the second embodiment are similar to protrusions 6 of the third group according to the first embodiment. They are made in the form of corners, having shelves positioned perpendicular to the base 1 planes on its adjacent ends and flush with these ends, with a length <<L>> equal to a and width <<B5>> no greater than <<0.5a>>. Protrusions 2, 4 and 6 are positioned on the base 1 according to the coordinate grid 7 of mutually perpendicular lines parallel to base 1 edges, wherein the distance <<B6>> between neighboring lines of the coordinate grid 7 is equal to <<2a>>, wherein the distance <<B7>> between the base 1 edges and neighboring lines on the coordinate grid 7 is <<0.5a>>. Protrusions 2 of the first group according to the second embodiment are positioned at points where the coordinate grid 7 lines intersect. Protrusions 4 of the second group according to the second embodiment are positioned in the middle between the neighboring protrusions 2 of the first group that are positioned flush with the ends of the base 1. Protrusions 6 of the third group according to the second embodiment are positioned in the corners of the base 1.

Figure 9:
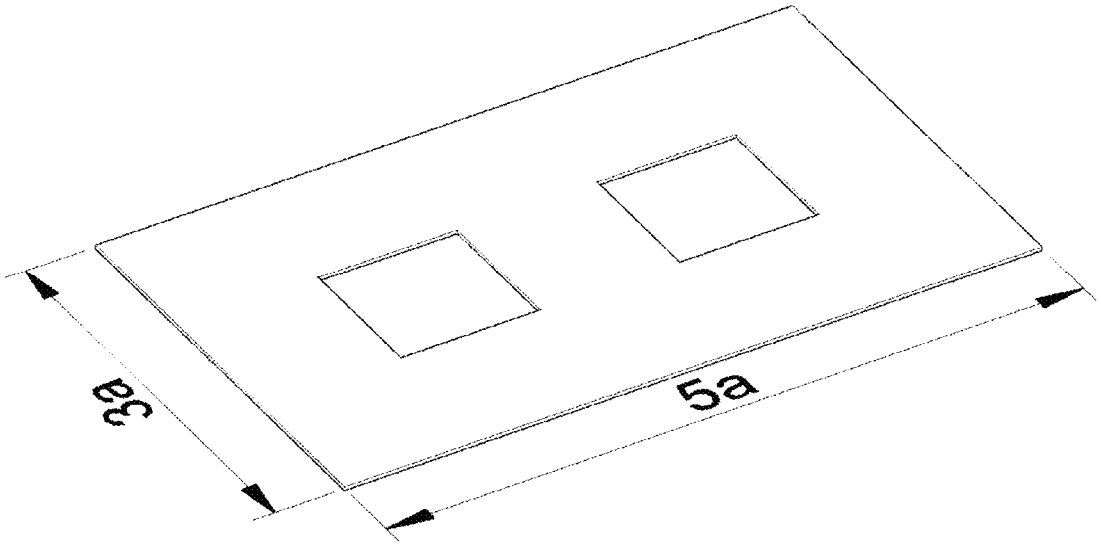
FIG. 9 shows an example of a base implemented according to the first embodiment.
Figure 10:
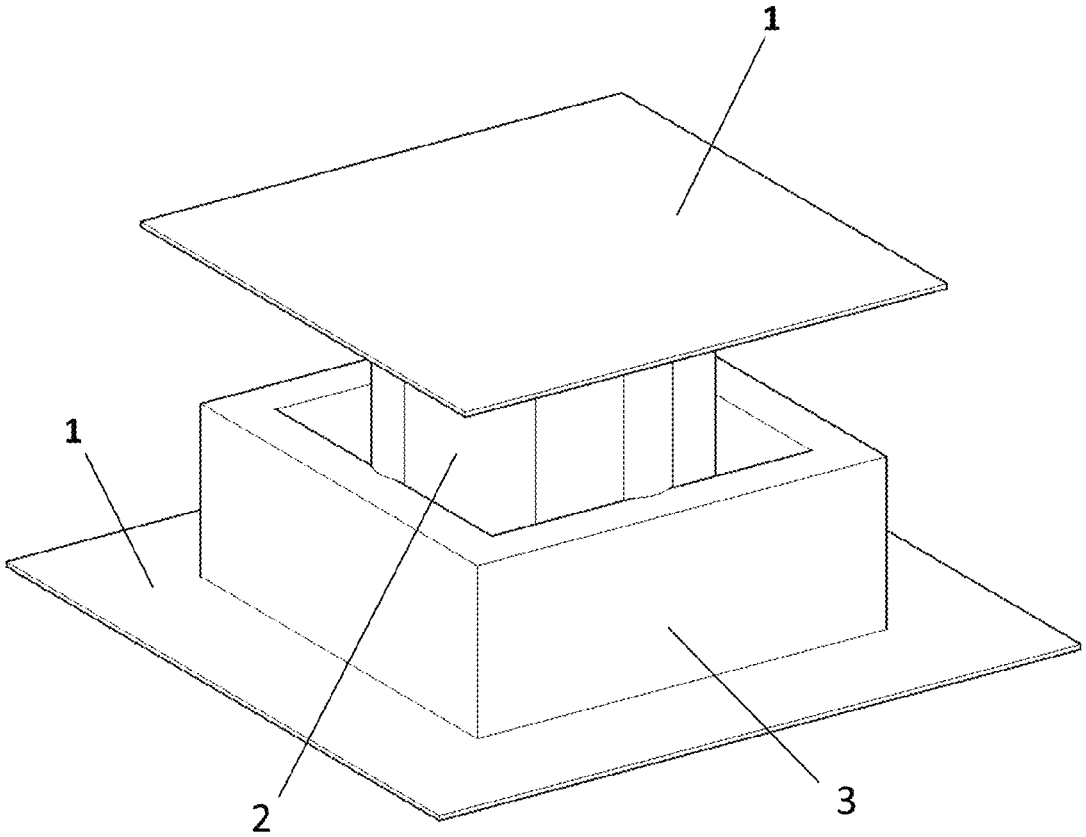
FIG. 10 shows the connection of protrusions of the third and second groups of the construction element implemented according to the first embodiment.
Figure 11:
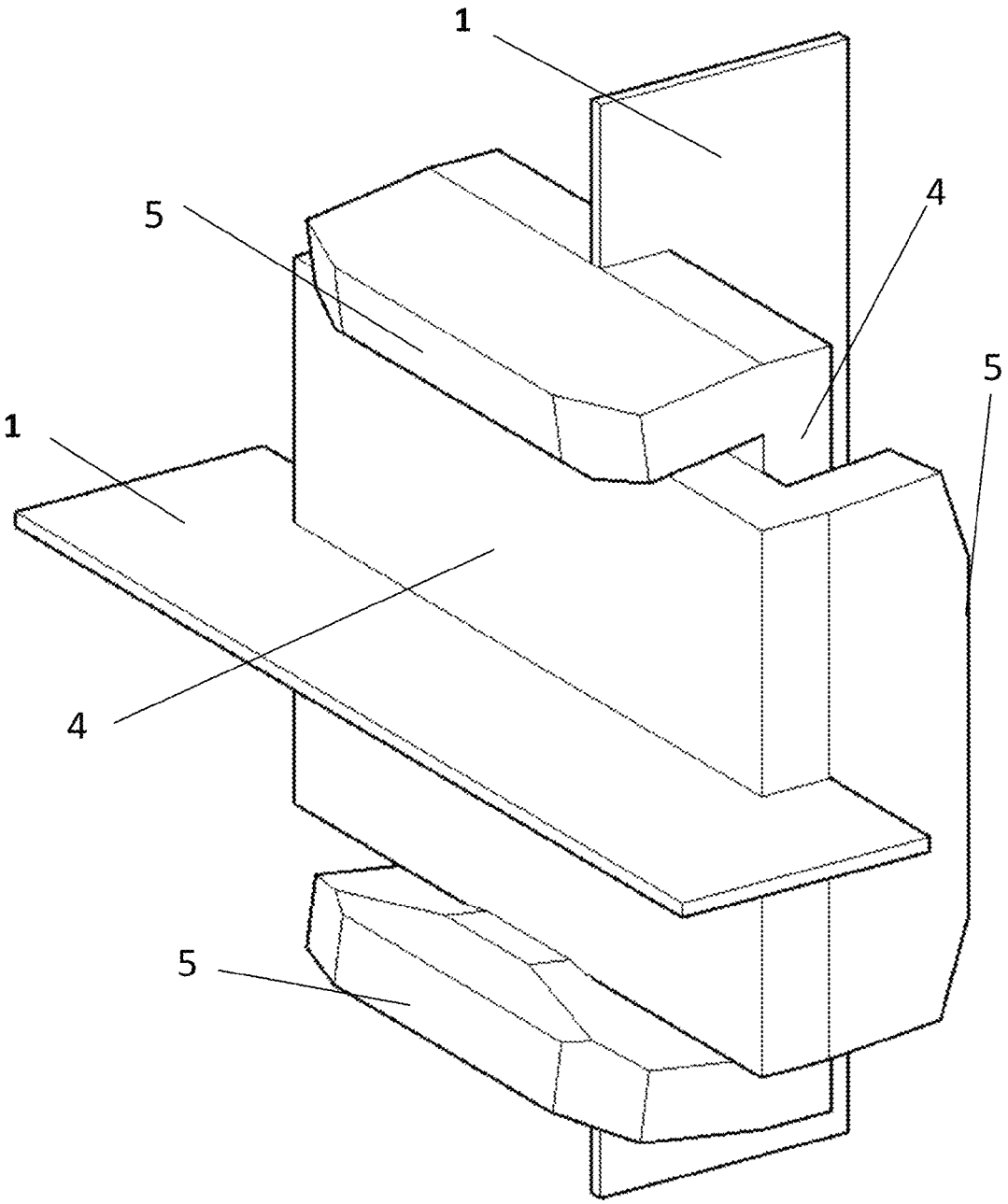
FIG. 11 shows the connection of protrusions of the third group of the construction element implemented according to the first embodiment or the connection of protrusions of the second group of the construction element implemented according to the second embodiment.
Figure 12:
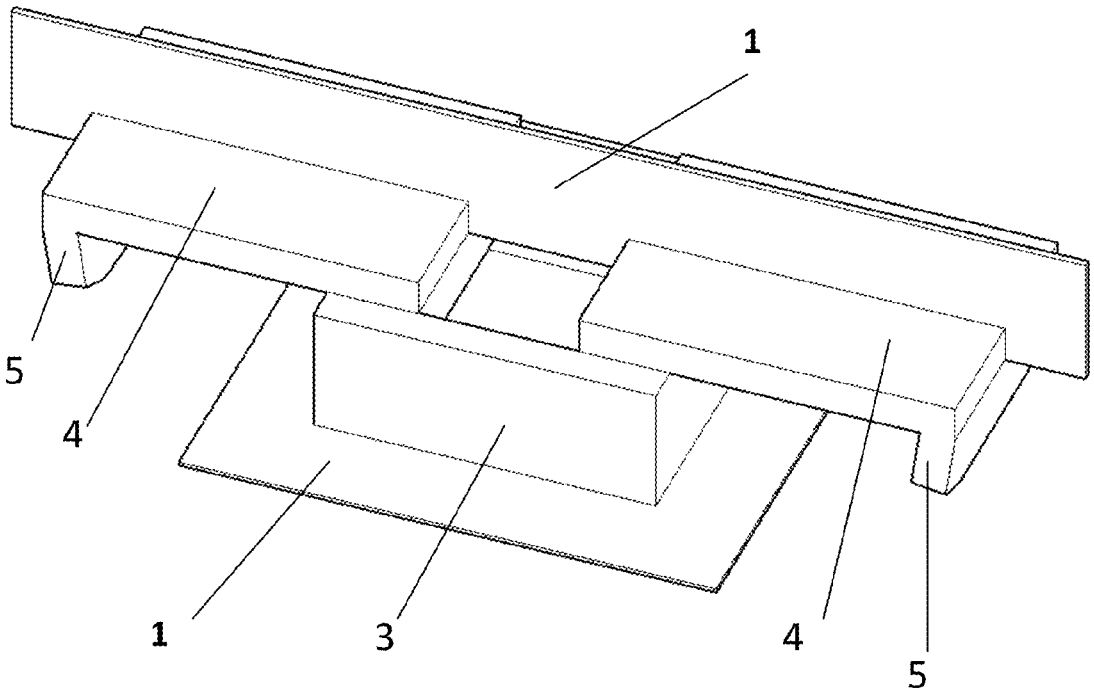
FIG. 12 shows the connection of protrusions of the second and third groups of the construction element implemented according to the first embodiment.
Figure 13:
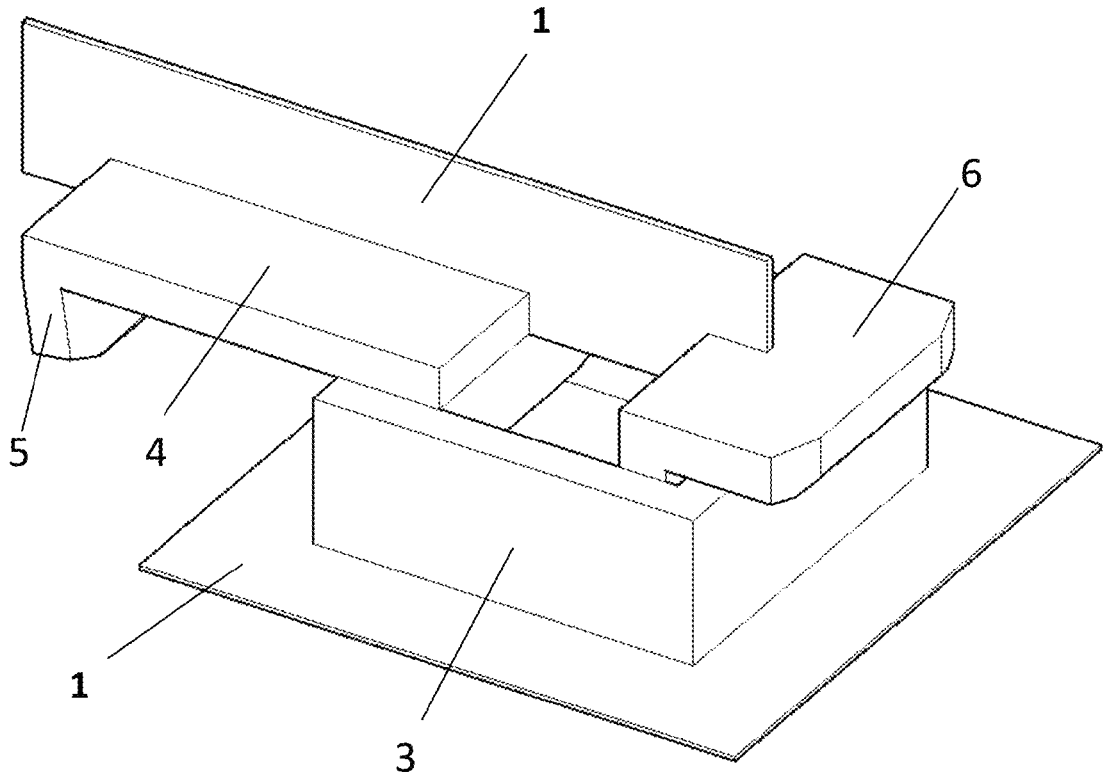
FIG. 13 shows the connection of protrusions of the second, third and fourth groups of the construction element implemented according to the first embodiment.
Figure 14:
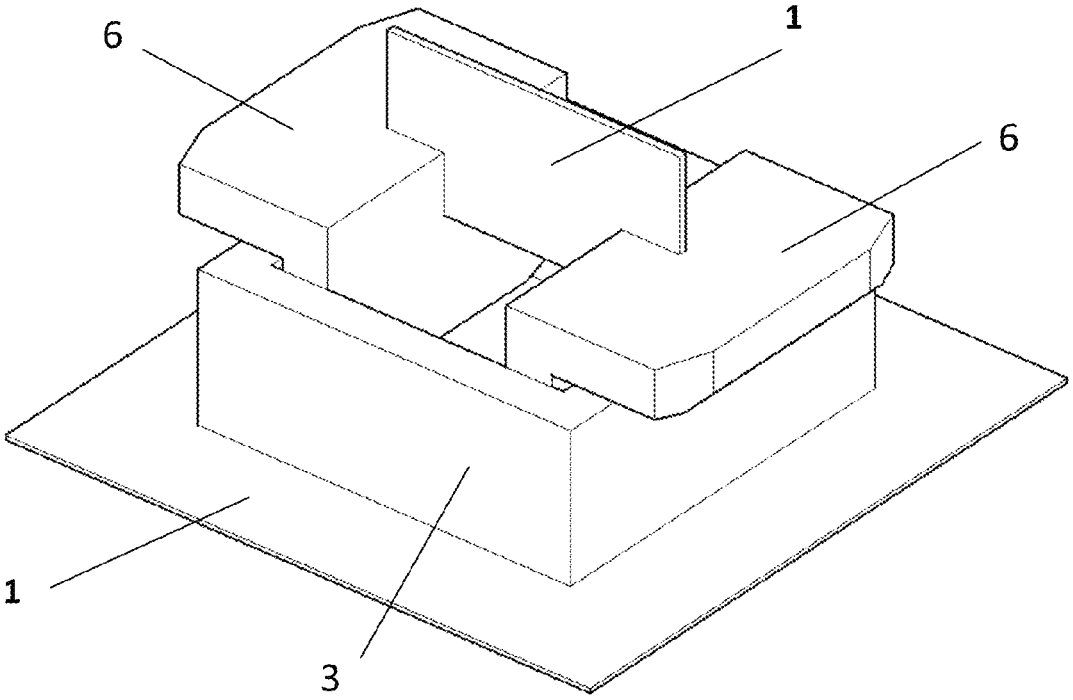
FIG. 14 shows the connection of protrusions of the second and fourth groups of the construction element implemented according to the first embodiment.
Figure 15:
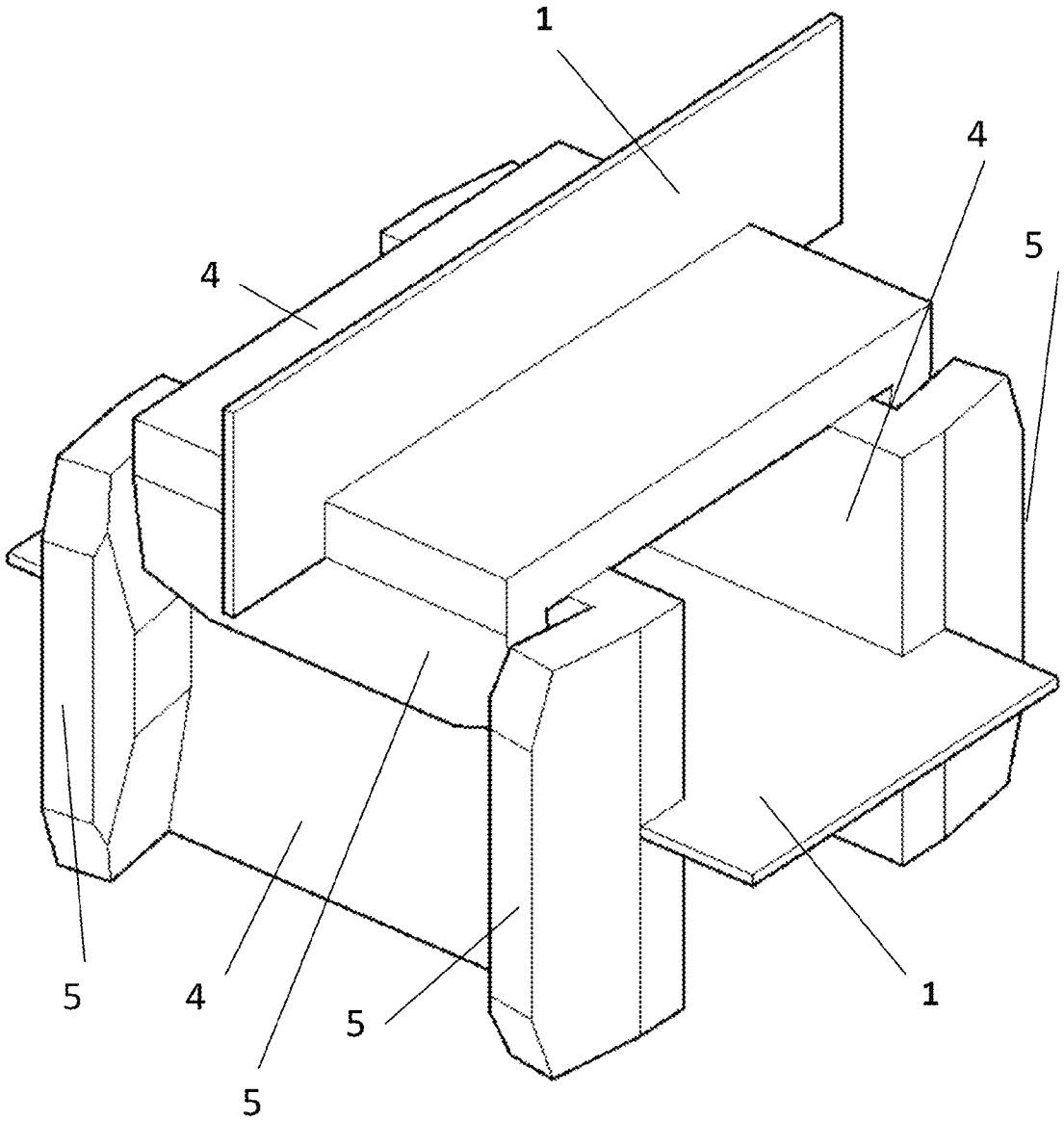
FIG. 15 shows the connection of three protrusions of the third group of the construction element implemented according to the first embodiment or the connection of three protrusions of the second group of the construction element implemented according to the second embodiment.
Figure 16:
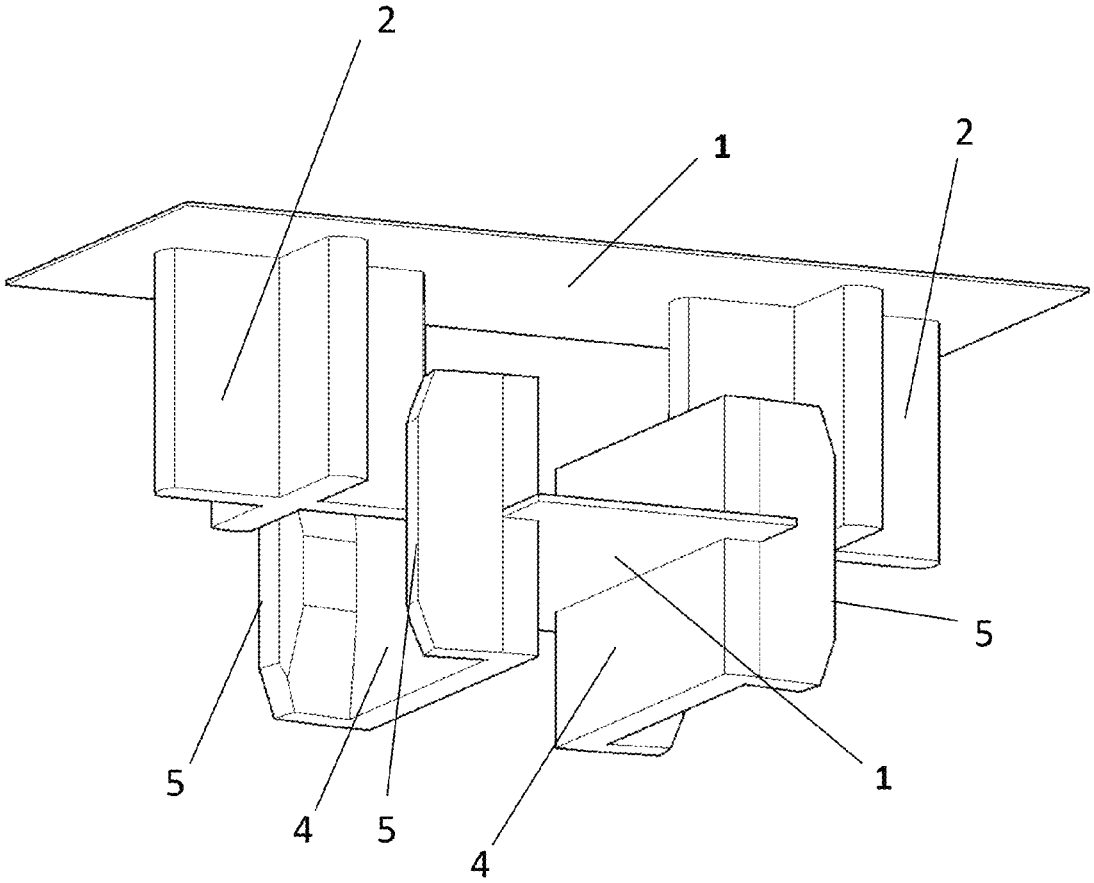
FIG. 16 shows the connection of two protrusions of the first group and two protrusions of the third group of the construction element implemented according to the first embodiment or the connection of three protrusions of the second group of the construction element shows two construction elements, connected to one another.
Figure 17:
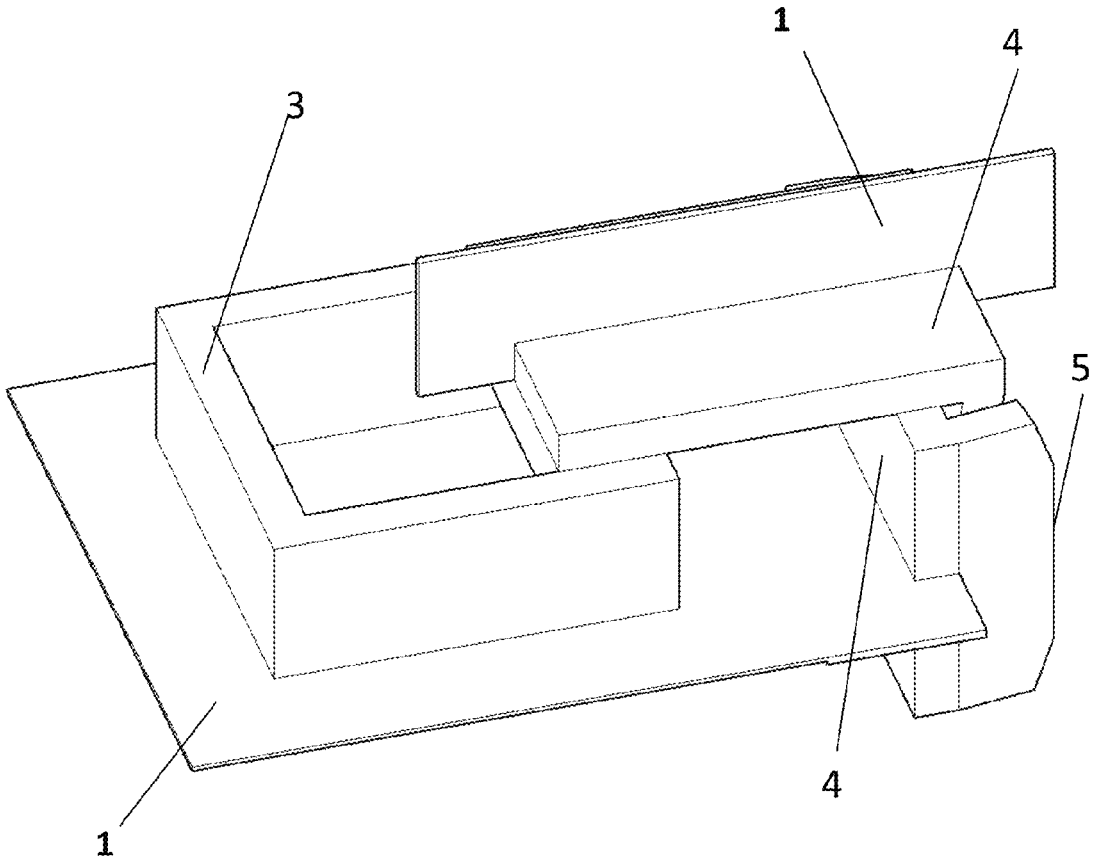
FIG. 17 shows the connection of two protrusions of the first group and two protrusions of the third group of the construction element implemented according to the first embodiment.
Figure 18:
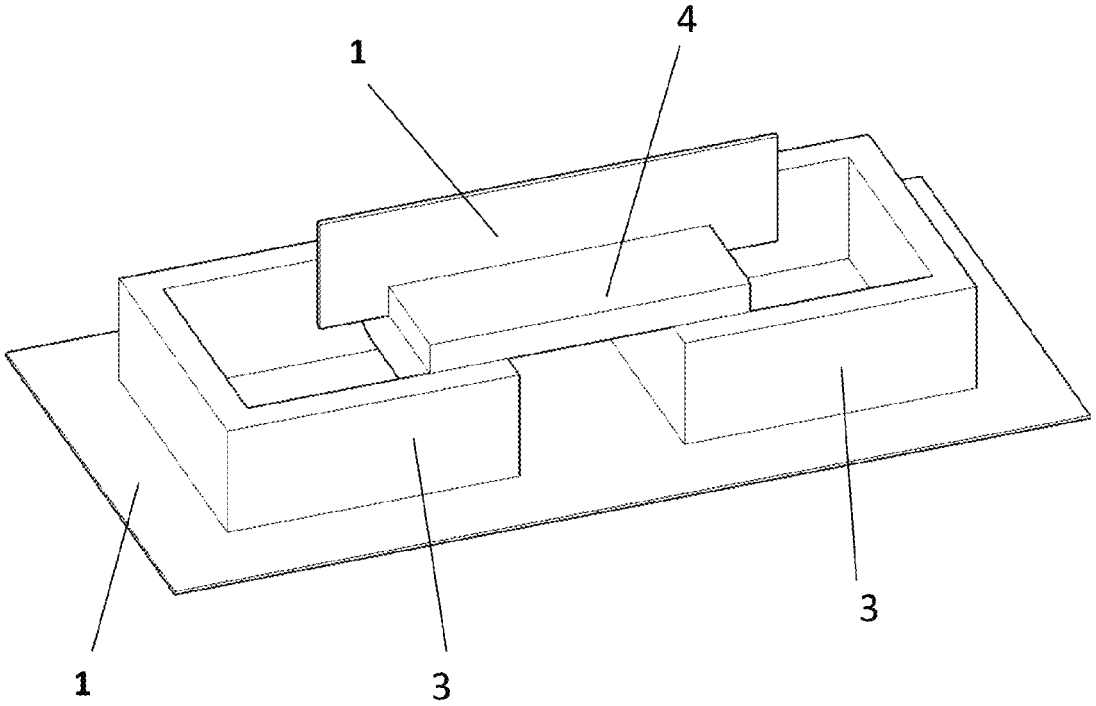
FIG. 18 shows the connection of two protrusions of the second group and one protrusion of the third group of the construction element implemented according to the first embodiment.
Figure 19:
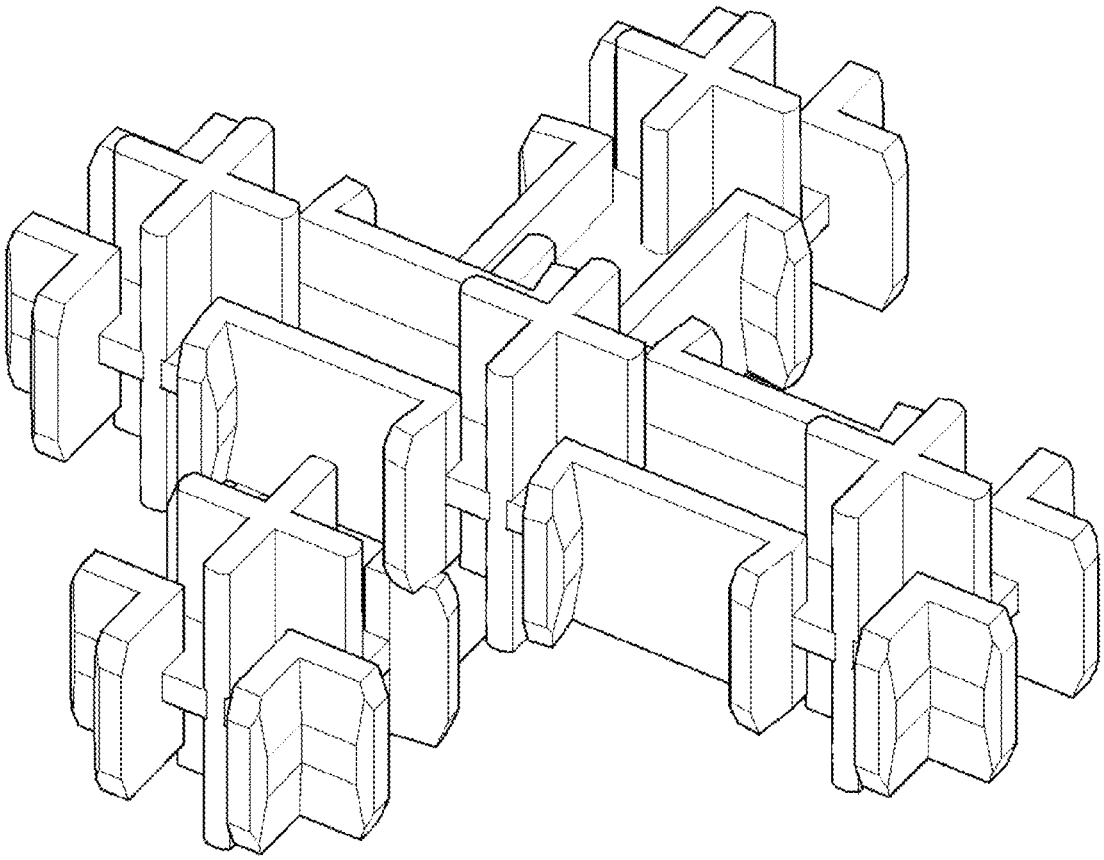
FIG. 19 shows the connection of two construction elements implemented according to the second embodiment where the double connection represented in FIG. 16 takes place.
Figure 20:
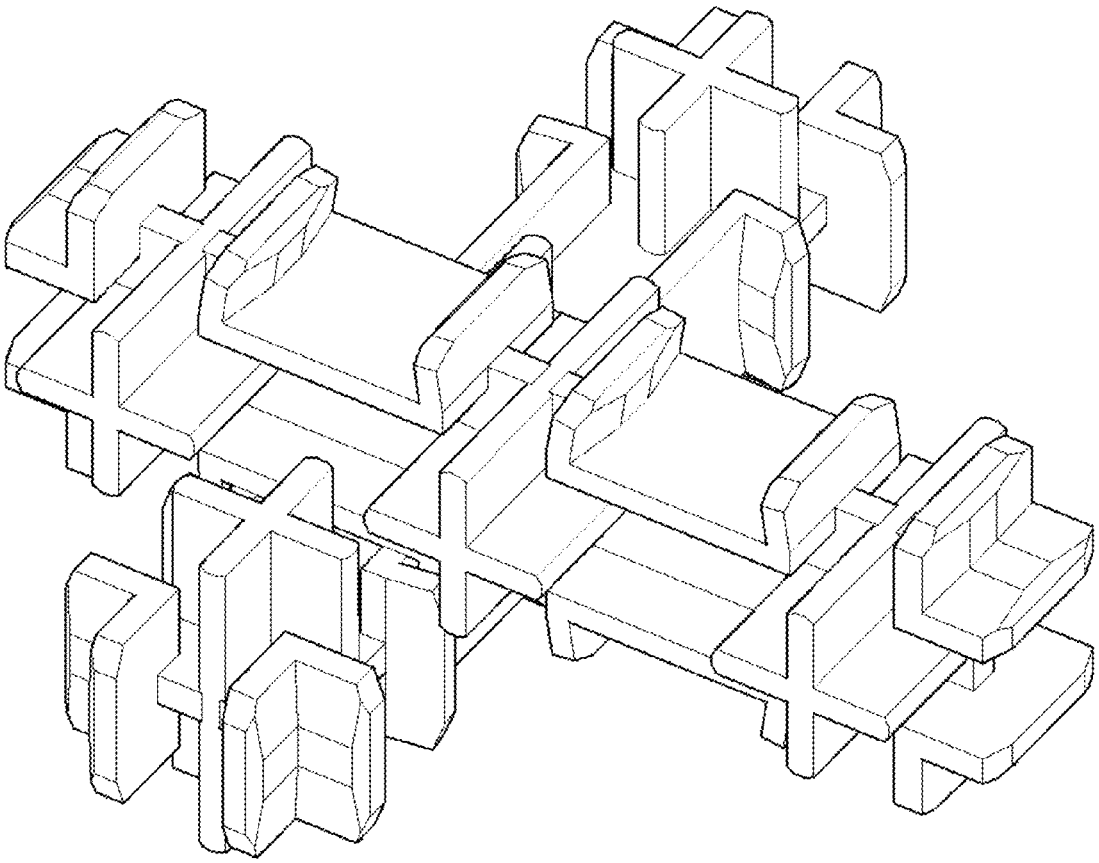
FIG. 20 shows the connection of two construction elements implemented according to the second embodiment where the connection represented in FIG. 15 takes place.
Figure 21:
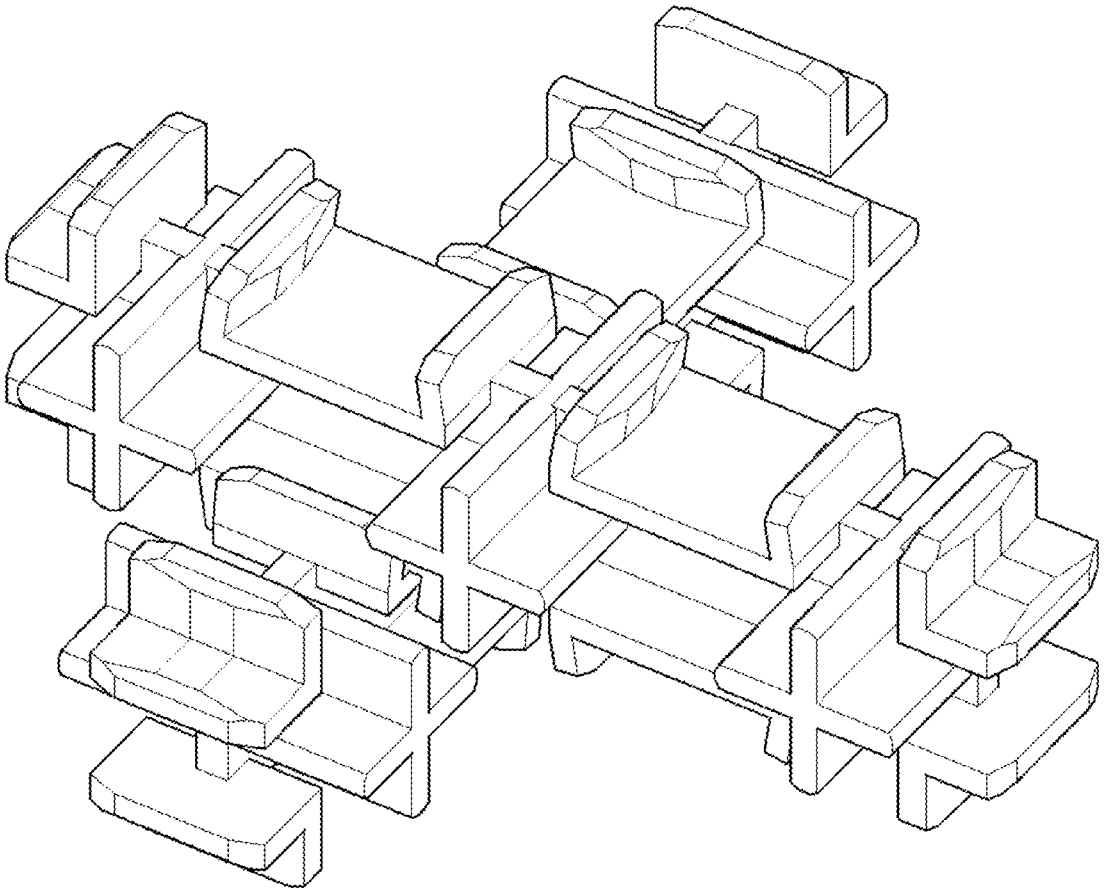
FIG. 21 shows the connection of two construction elements implemented according to the second embodiment where the connection represented in FIG. 12 takes place.
Figure 22:
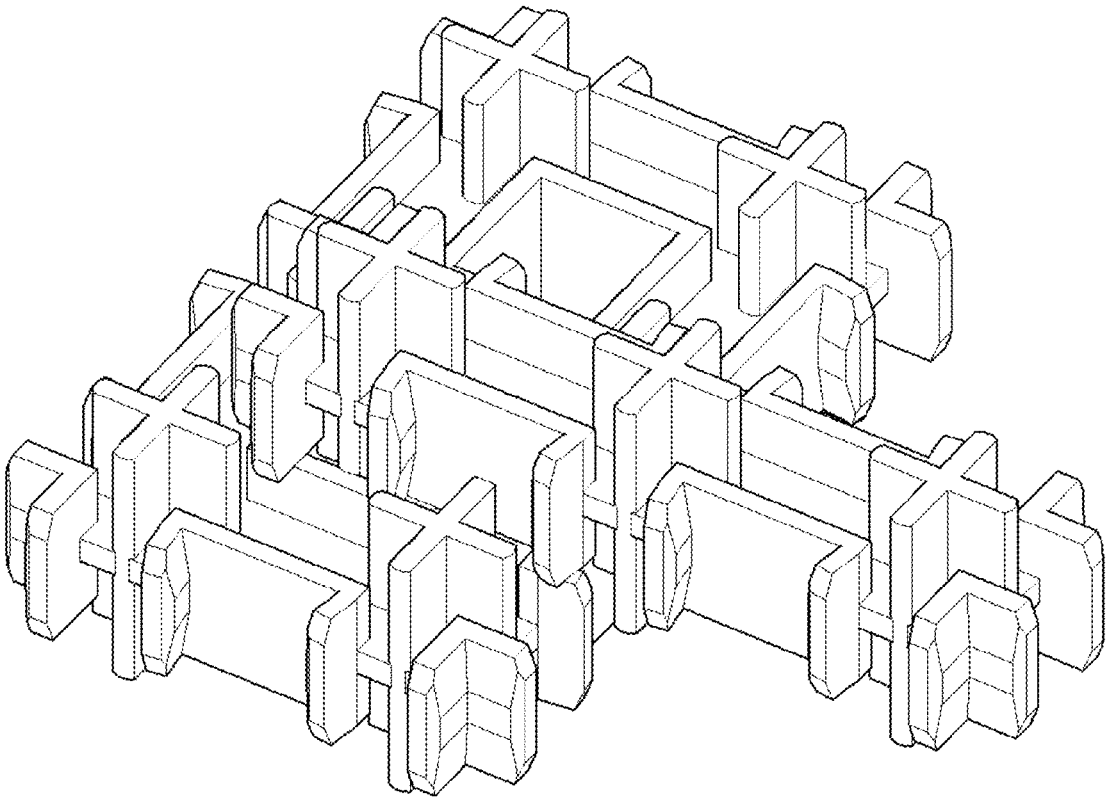
FIG. 22 shows the connection of one construction element implemented according to the first embodiment with another construction element implemented according to the second embodiment where the connection represented in FIG. 10 takes place.
Figure 23:
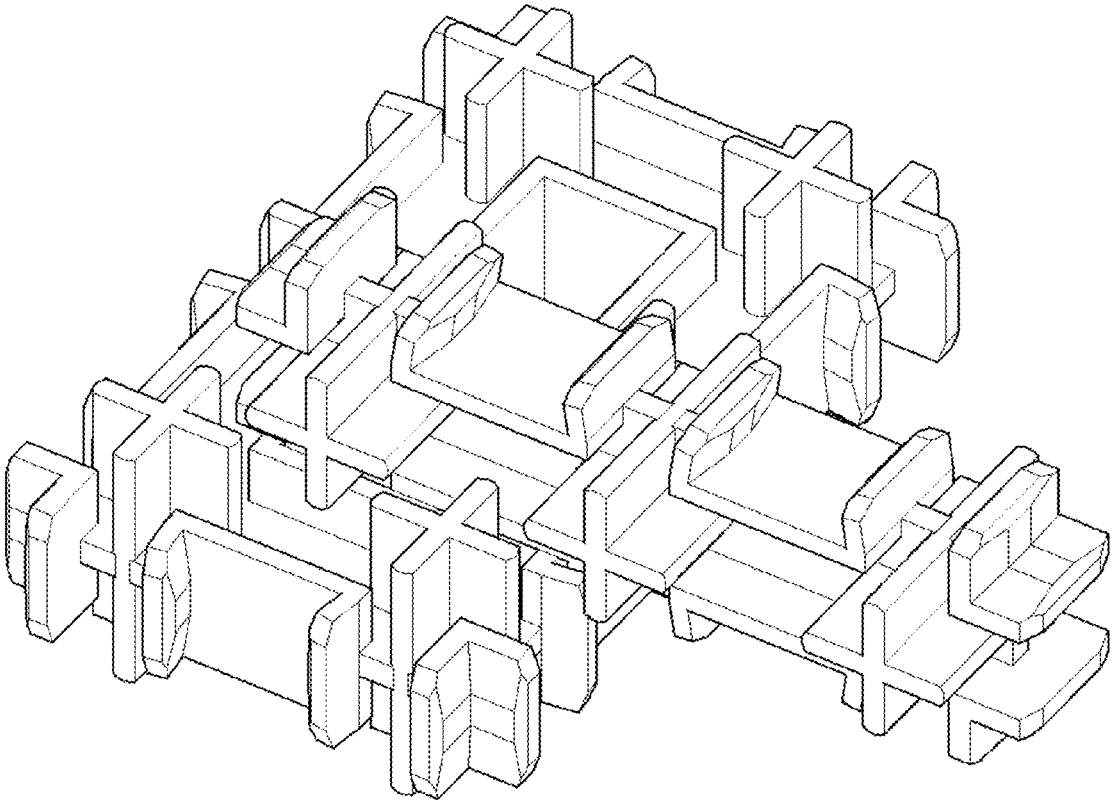
FIG. 23 shows the connection of one construction element implemented according to the first embodiment with another construction element implemented according to the second embodiment where the connections represented in FIGS. 13 and 17 take place.
Figure 24:
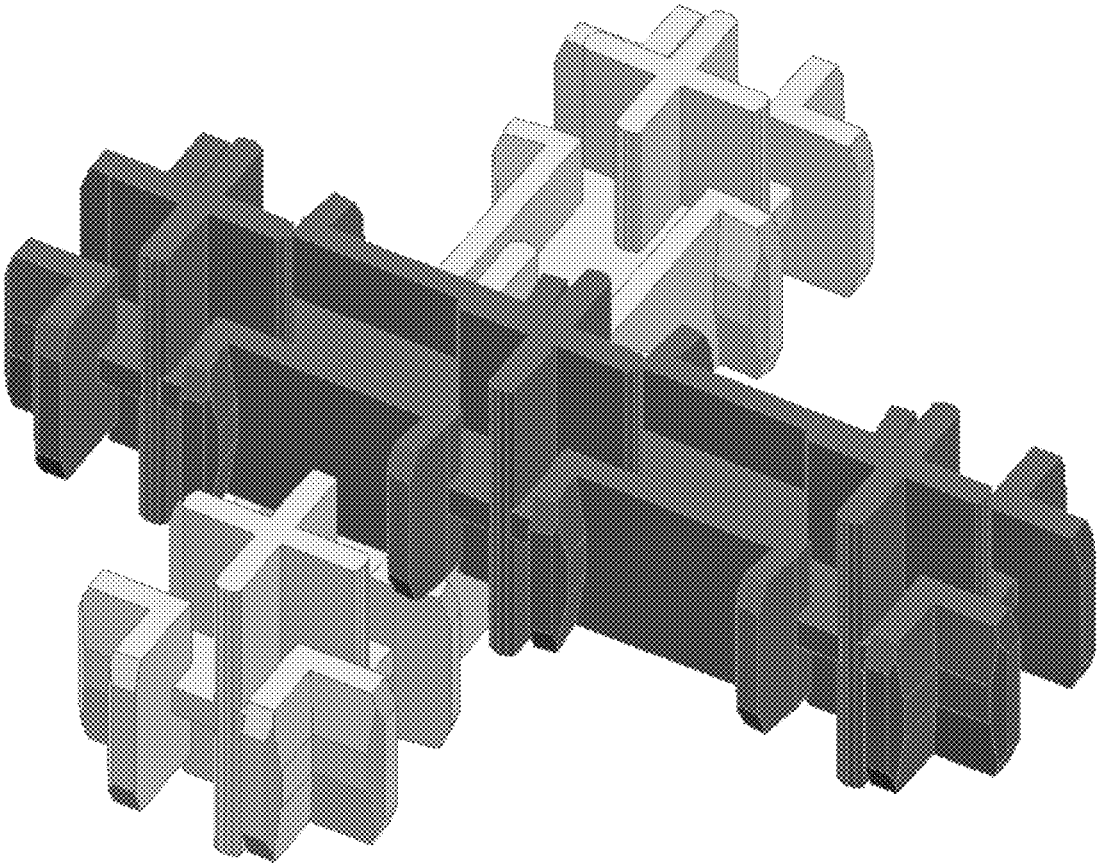
FIGS. 24-28 show the connections represented in FIGS. 19-23. These
Figure 25:
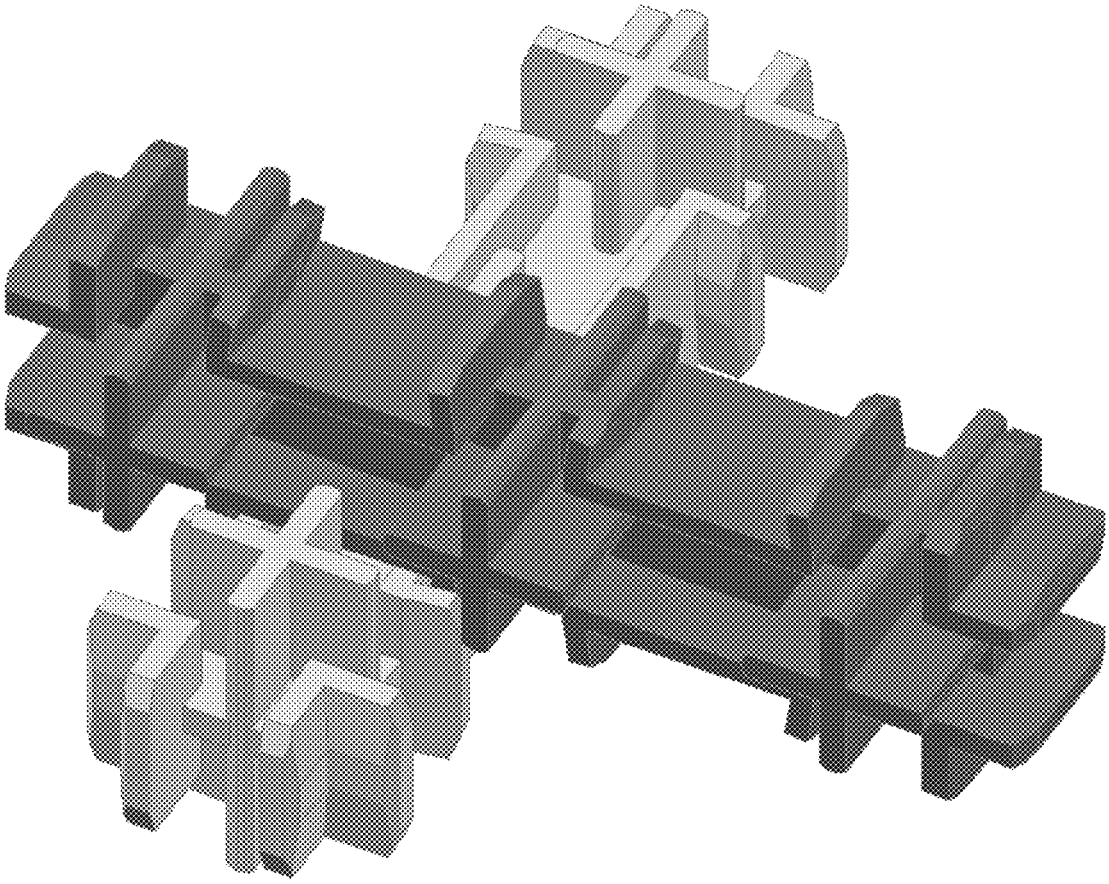
Figure 26:
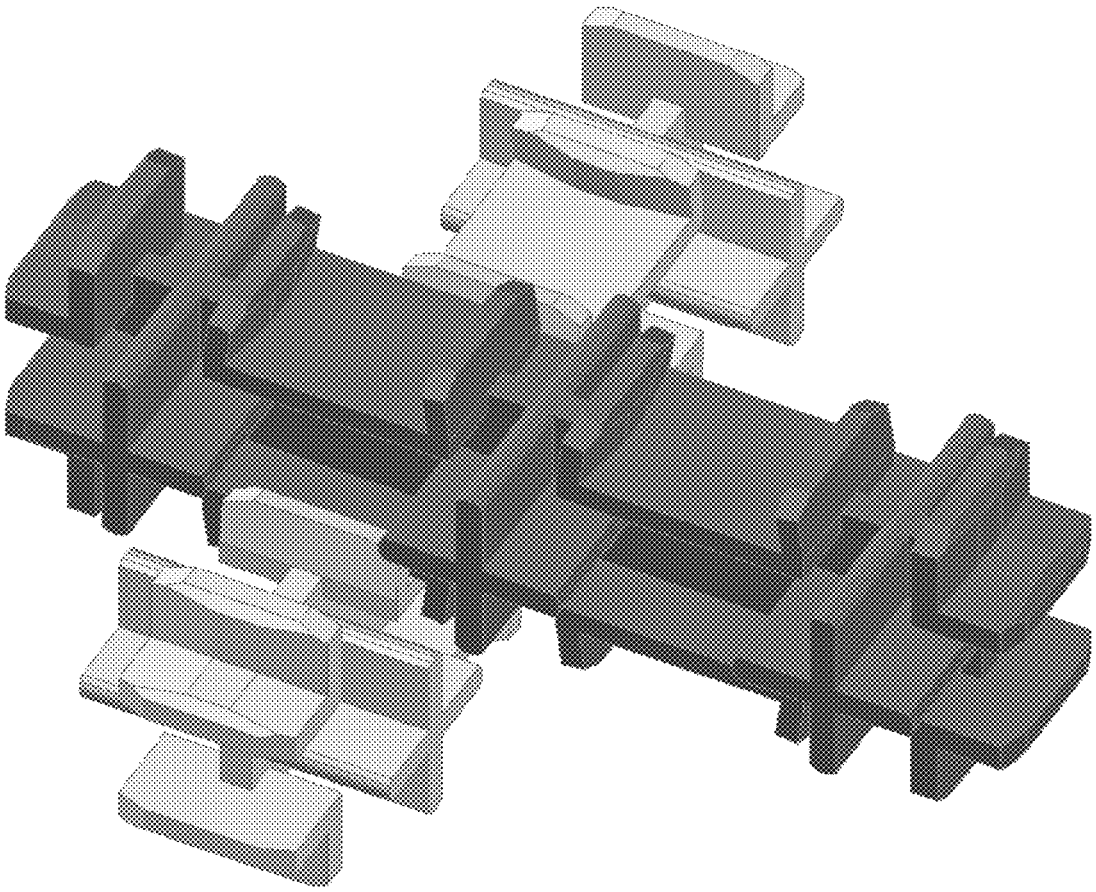
Figure 27:
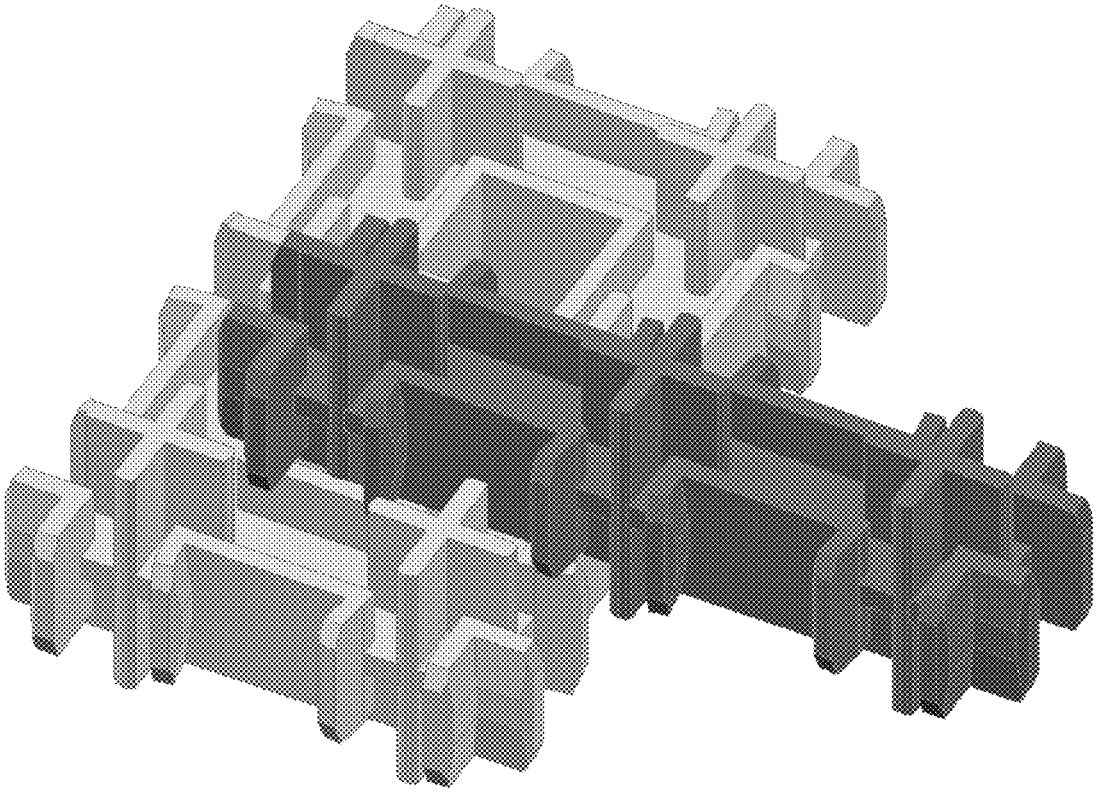
Figure 28:
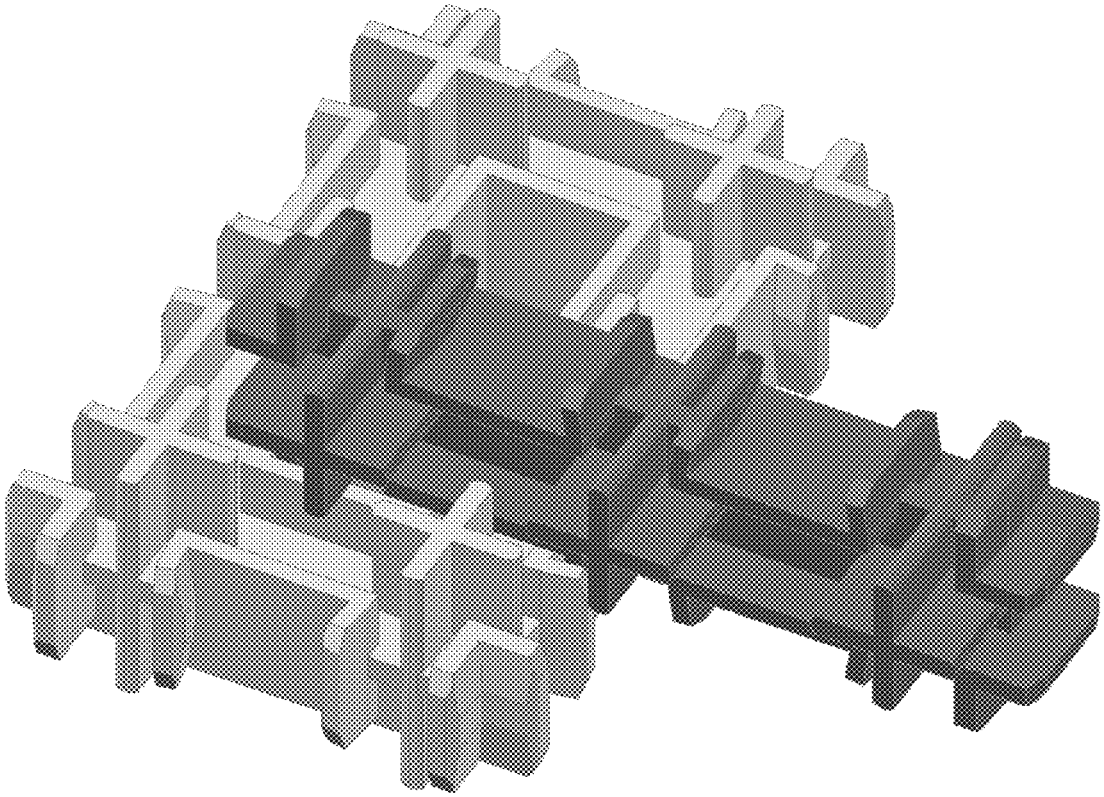

Protrusions of interlocking joints, for a more precise positioning of construction elements during connection with each other, can be implemented with bevels, rounded off, sloped, and so forth. The base 1 can also be made with various openings to conserve materials. For instance, the openings may be made inside the protrusions 3 of the second group according to the first embodiment (see FIG. 9).

Figure 5:
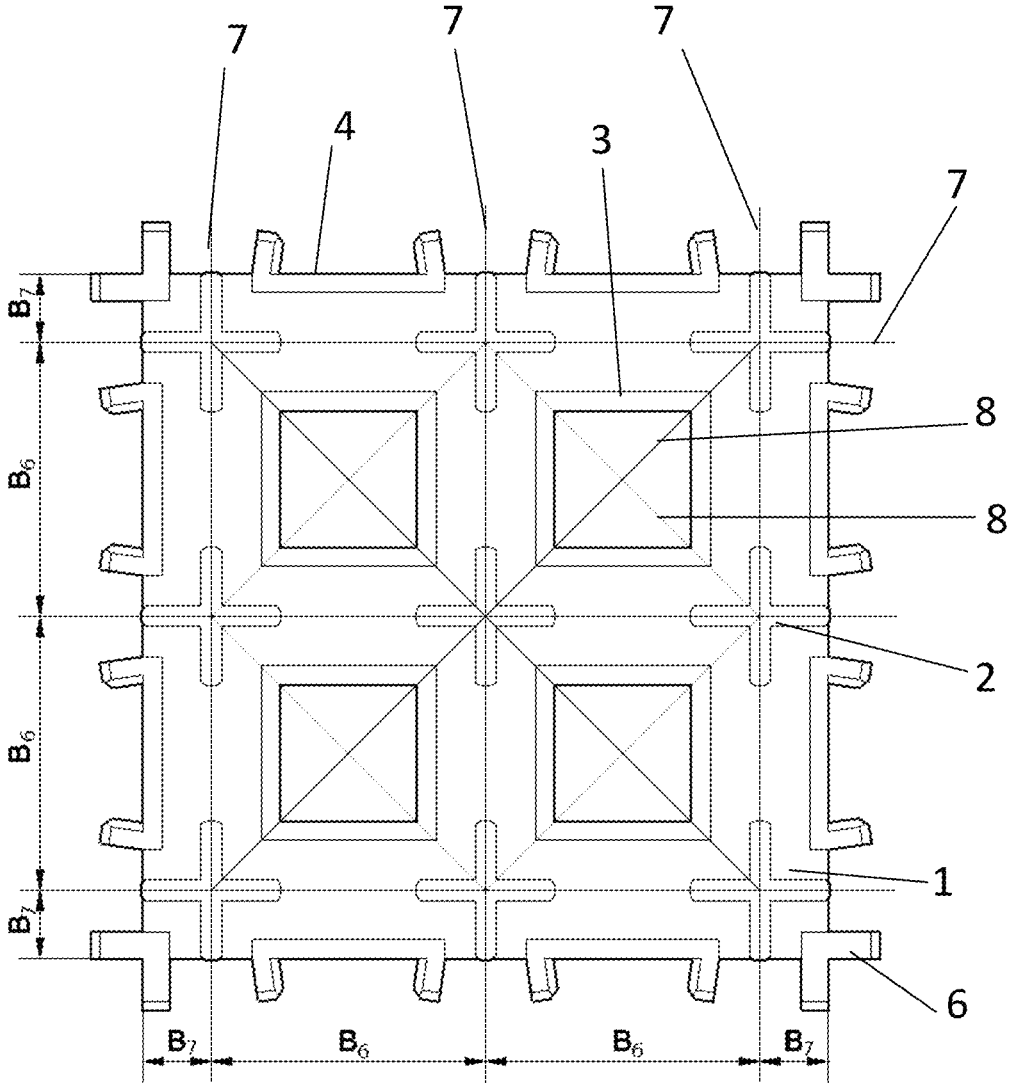
FIG. 5 shows construction elements implemented according to the first embodiment with 9 protrusion of the first group, with 4 protrusion of the second group, with 8 protrusion of the third group and with 4 protrusion of the fourth group and with base having size <<5a>> by <<5a>>.
Figure 6:
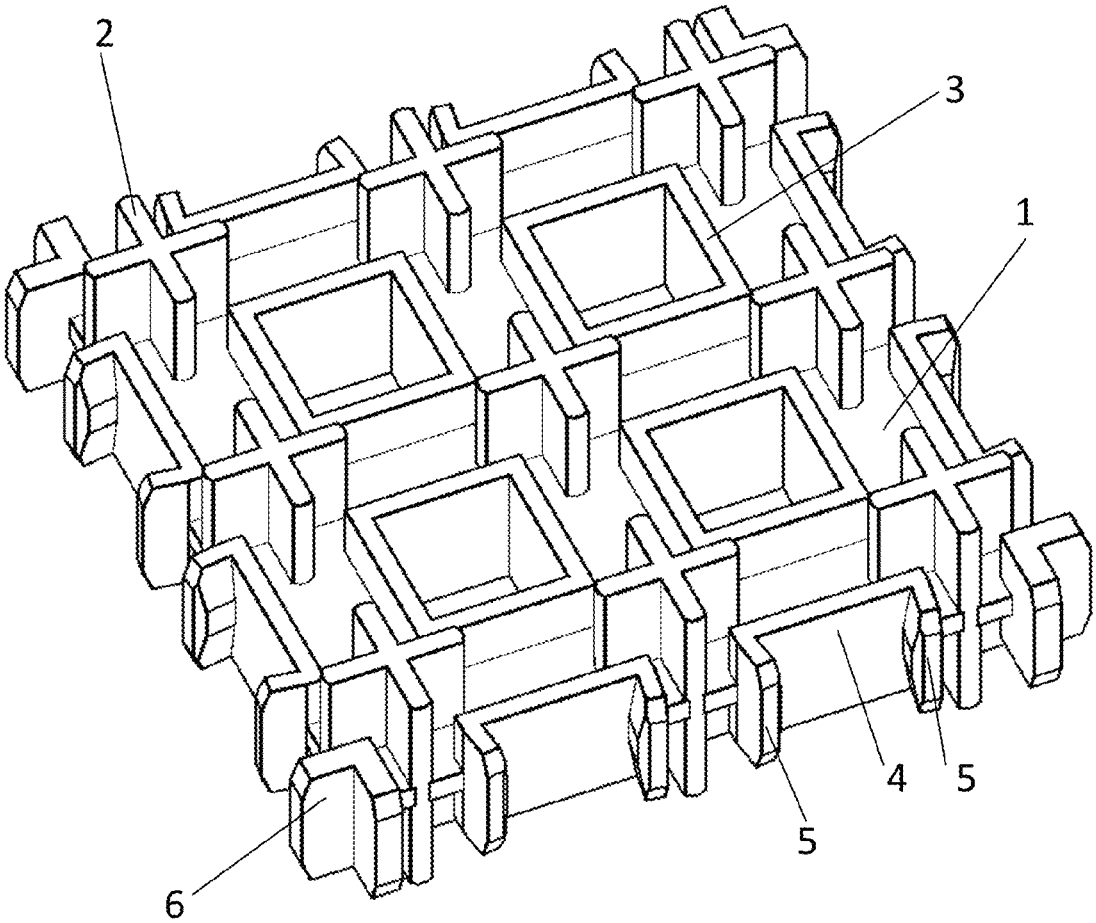
FIG. 6 shows an isometric view of construction elements implemented according to the first embodiment with 9 protrusion of the first group, with 4 protrusion of the second group, with 8 protrusion of the third group and with 4 protrusion of the fourth group and with base having size <<5a>> by <<5a>>.
Figure 7:
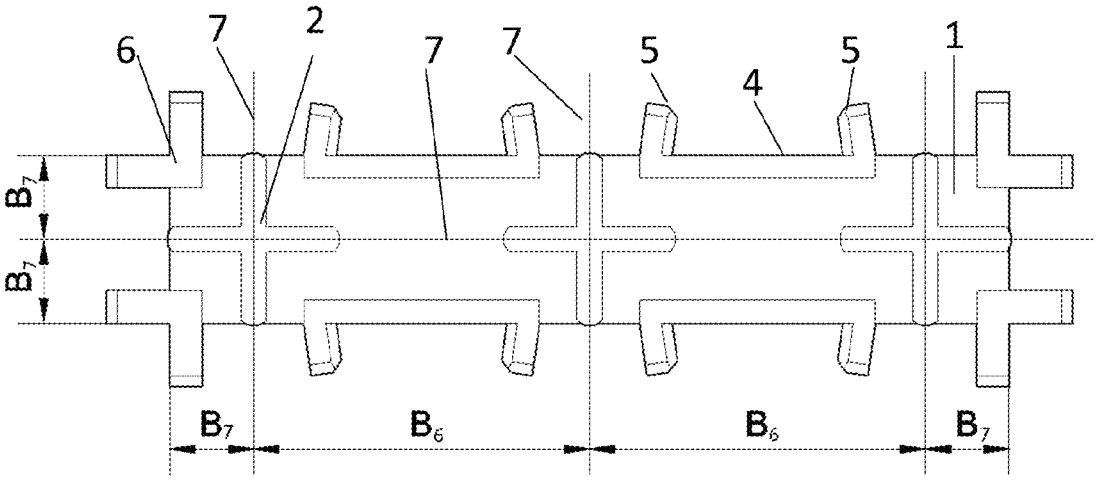
FIG. 7 shows construction elements implemented according to the second embodiment with 3 protrusion of the first group, with 4 protrusion of the second group, with 4 protrusion of the third group and with base having size <<5a>> by a <<a>>.
Figure 8:
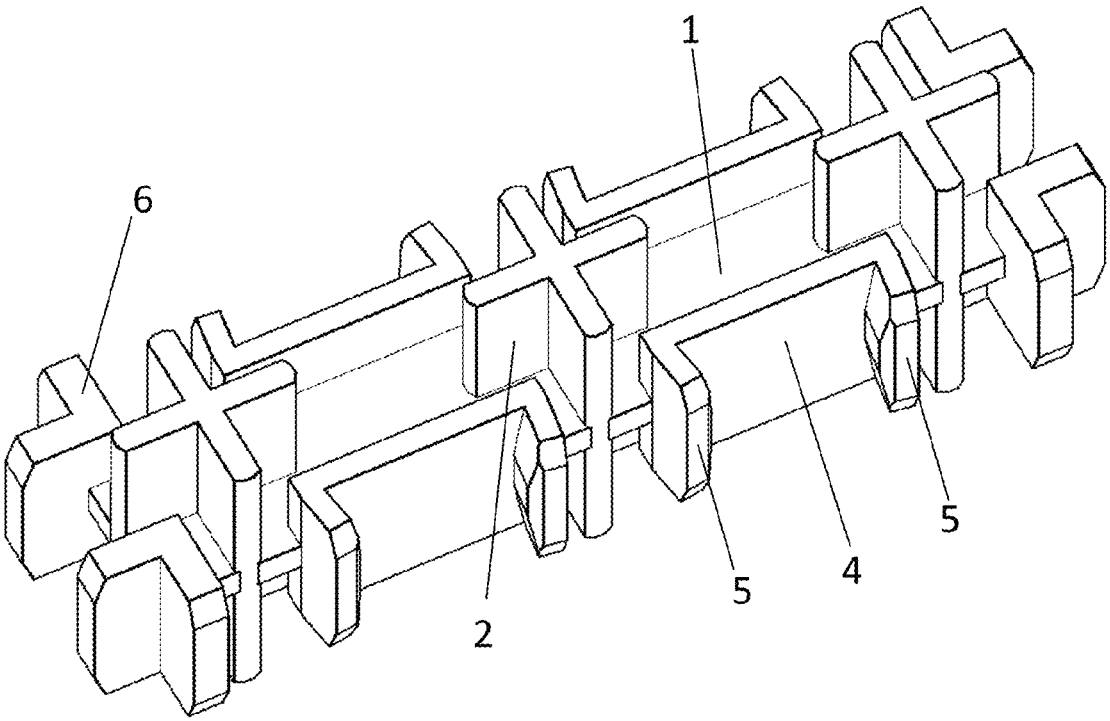
FIG. 8 shows an isometric view of construction elements implemented according to the second embodiment with 3 protrusion of the first group, with 4 protrusion of the second group, with 4 protrusion of the third group and with base having size <<5a>> by <<a>>.

Positioning of interlocking joints on base 1 is presented in FIGS. 5 and 7, in particular. When connecting construction elements to one another, the protrusions of different elements interlock with each. Interlocking is based on the force of friction, occurring between protrusions during close contact and/or when they are placed between other protrusions.

When connecting elements to one another, the protrusions of different groups simultaneously engage in interlocking from any side, which provides opportunity to make complicated volumetric (3-dimensional) models (see FIGS. 19-23).

What is claimed is:

1. A construction element, comprising: a flat base having two sides, a rectangular form, base edges having lengths in multiples of <<a>>, and an interlocking joint created by positioning four types of protrusions on the base, wherein:

a first protrusion type is positioned on at least one side of the base, with a height greater than <<0.5a>>, but not greater than <<a>>, made with a cross-shaped cross-section, where a distance between opposite ends of the cross-shaped cross-section is equal to <<a>>, a second protrusion type is positioned on at least one side of the base, with a height equal to <<0.5a>>, made tubular with a cross-section in a form of square having sides equal to <<a>>, a third protrusion type is made in the form of a rectangular plate with ledges and a long midline, positioned so that the long midline of the rectangular plate is along the base edges and the ledges extend from short sides of the rectangular plate, the ledges having ledge end parts that have a width equal to <<a>>, protruding not more than <<0.5a>> from the base edges, angled towards each other with a gap formed between their ledge end parts no greater than <<a>>, a fourth protrusion type is made in the form of a corner, having shelves positioned perpendicular to each other and extending outwardly from the base and having a length equal to <<a>> and a width not greater than <<0.5a>>, wherein all protrusions are positioned on the base in accordance with a coordinate grid of lines, wherein a distance between neighboring parallel coordinate grid lines on the coordinate grid is equal to <<2a>>, a distance between a base edge and a neighboring parallel coordinate grid line on the coordinate grid is equal to <<0.5a>> and cells of the coordinate grid are formed by pairs of intersecting parallel neighboring coordinate grid lines, and the protrusions of the first protrusion type are positioned at points where the coordinate grid lines intersect, the protrusions of the second protrusion type are positioned at points where diagonals of the cells of the coordinate grid intersect, the protrusions of the third protrusion type are positioned in a middle between neighboring protrusions of the first protrusion type, and the protrusions of the fourth protrusion type are positioned at corners of the base.

2. A construction element, comprising: a flat base having two sides, a rectangular form with at least one base edge having a first length equal to <<a>>, and another base edge having a second length that is a multiple of <<a>>, and an interlocking joint, created by positioning three types of protrusions on the base, wherein:

a first protrusion type is positioned on at least one side of the base, with a height greater than <<0.5a>>, but not greater than <<a>>, made with a cross-shaped cross-section, where a distance between opposing ends of the cross-shaped cross-section is equal to <<a>>, a second protrusion type is made in the form of a rectangular plate with ledges and a long midline, positioned so that the long midline of the rectangular plate is along the base edges of the second length and the ledges extend from short sides of the rectangular plate, the ledges having ledge end parts that have a width equal to <<a>>, protruding not more than <<0.5a>> from the base edges of the second length, and angled towards each other with a gap formed between their with ledge end parts no greater than <<a>>, a third protrusion type is made in the form or a corner, having shelves positioned perpendicular to each other and extending outwardly from the base and having a length equal to <<a>> and a width not greater than <<0.5a>>, wherein all protrusions are positioned on the base in accordance with a coordinate grid of lines, wherein a distance between neighboring parallel coordinate grid lines on the coordinate grid is equal to <<2a>> and a distance between a base edge and a neighboring parallel coordinate grid line on the coordinate grid is equal to <<0.5a>>, wherein the protrusions of the first protrusion type are positioned at points where the coordinate grid lines intersect, the protrusions of the second protrusion type are positioned in a middle between neighboring protrusions of the first protrusion type, and the protrusions of the third protrusion type are positioned at corners of the base.

* * * * *